US005584567A

United States Patent [19]

Rumpel

[11] Patent Number: 5,584,567

[45] Date of Patent: Dec. 17, 1996

[54] DECORATIVE LIGHT MOUNT

[76] Inventor: Donald Rumpel, HC-01 Box 216, Kellogg, Id. 83837

[21] Appl. No.: 476,011

[22] Filed: Jun. 7, 1995

[51] Int. Cl.[6] ..... F21P 1/02

[52] U.S. Cl. ..... 362/249; 362/123; 362/396; 362/391; 248/229.16; 439/575; 439/460

[58] Field of Search ..... 362/396, 249, 362/806, 226, 123, 391; 439/419, 558, 456, 470, 471, 460, 699.1, 575, 453, 506, 502, 505, 452; 248/229.16, 229.26, 316.1, 316.7, 74.2

[56] References Cited

U.S. PATENT DOCUMENTS

| | | | |
|---|---|---|---|
| 2,599,303 | 6/1952 | Ward | 362/396 |
| 3,206,712 | 9/1965 | Schick et al. | 439/419 |
| 3,335,389 | 8/1967 | Reichardt | 439/505 |
| 4,679,126 | 7/1987 | Van Sickler | 362/226 |
| 4,802,072 | 1/1989 | Kau | 362/806 |
| 5,192,127 | 3/1993 | Schaef | 362/226 |
| 5,288,047 | 2/1994 | Pan | 248/229.26 |
| 5,428,518 | 6/1995 | Huang | 362/396 |
| 5,481,444 | 1/1996 | Schultz | 439/463 |

FOREIGN PATENT DOCUMENTS

| | | | |
|---|---|---|---|
| 672562 | 10/1963 | Canada | 362/391 |

*Primary Examiner*—Ira S. Lazarus
*Assistant Examiner*—Thomas M. Sember
*Attorney, Agent, or Firm*—Wells, St. John, Roberts, Gregory & Matkin, P.S.

[57] ABSTRACT

A decorative lighting mount is described, including a plastic body with a flexible integral mounting clip for attaching the mount to a support, and an integral flexible socket receiving clip for reception of a decorative light bulb socket. The mounting clip includes a pair of opposed yieldable clip arms forming a support receiving opening therebetween. The socket receiving clip defines a socket receiving opening and includes an axially split side wall in a frusto-conical configuration to releasably receive a portion of a decorative light bulb socket. The socket receiving clip includes a retainer projecting radially into the socket receiving opening to abut a decorative light bulb socket to prevent axial motion of the bulb socket within the socket receiving clip in one direction.

19 Claims, 7 Drawing Sheets

DECORATIVE LIGHT MOUNT

TECHNICAL FIELD

The present invention relates to attachment of decorative lights, especially strands of decorative electric lights such as Christmas lights to a support.

BACKGROUND OF THE INVENTION

Those who like to decorate for Christmas and other holidays or special occasions often use multiple strands of lights, and attach the lights to various objects for decorative effect. Plants and structures are often used to support the light strands. Further, wire or rod forms are currently being produced as mandrels for supporting the lights in various sculptural shapes.

A problem has existed with such displays, since there are typically no clips on the light strands that will permit mounting to the wire or rod forms. Further, light strands that do include clips are usually intended for connection to tree branches and therefore have little if any utility in attaching the light sockets to other supports.

For example, it becomes extremely difficult, frustrating and time consuming to secure light strands in precise formation along wire or rod forms. The lights tend to randomly project to one side or the other of the wires or rods.

This is due at least in part to the wires connecting the lights. The wires tend to become twisted and will therefore urge the light sockets to turn randomly to one side or another of the wire. In intricate sculptural forms, such random spacing and positioning of the light sockets is undesirable.

As a solution to the above problem many decorators attempt to attach the lights using wire "ties", tape, string, rubber bands, or other conventional fasteners. If care is taken, these standard forms of attachment operate reasonably well.

Wire ties are probably the most frequently used fasteners, but are difficult and time consuming to apply. Even then there is no real assurance that the lights will remain in desired angular relation to the support to which the lights are to be attached. Further, the ties are difficult to remove and must be destroyed to permit removal of the lights from a support. A need therefore remains for a decorative light mount with an integral clip that will secure the light socket in a consistent manner, and that facilitates easy mounting and dismounting of a light string to and from a support.

The above needs are successfully filled by the present invention which is described in detail below.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

Figure 5:
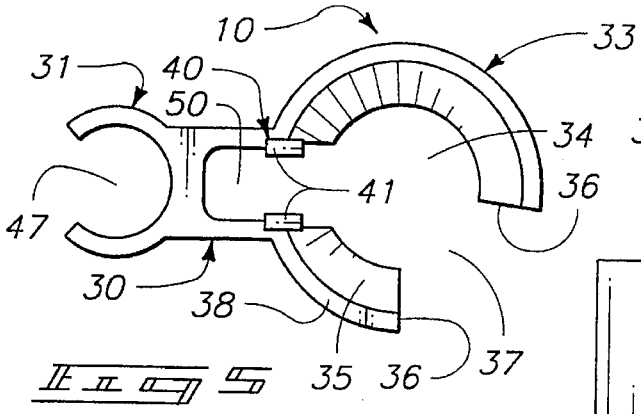
FIG. 5 is a top plan view of the mount.
Figure 2:
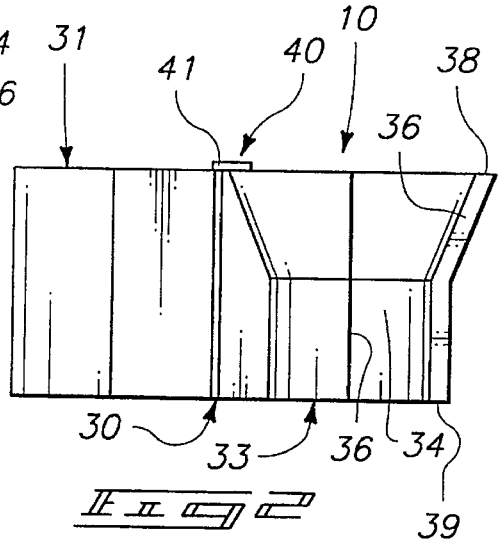
FIG. 2 is a side elevation view of a presently preferred form of mount.
Figure 4:
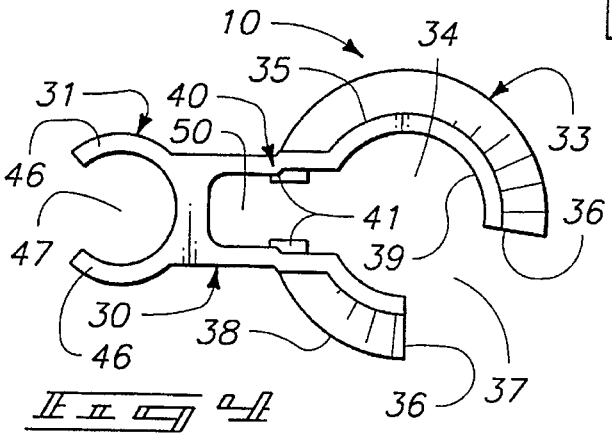
FIG. 4 is a bottom plan view of the mount.
Figure 3:
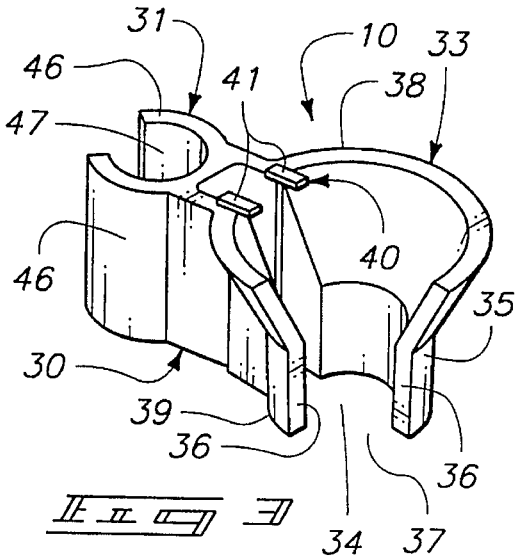
FIG. 3 is a perspective view of the mount.

This disclosure of the invention is submitted in furtherance of the constitutional purposes of the U.S. Patent Laws "to promote the progress of science and useful arts" (Article 1, Section 8).

Two preferred forms of the present invention are generally shown in the drawings by the reference numeral 10, to provide secure yet easily removable mounting of conventional decorative Christmas light bulbs to support surfaces. A first preferred form is illustrated in FIGS. 1–10. A second preferred form is illustrated in FIGS. 11–15.

Figure 1:
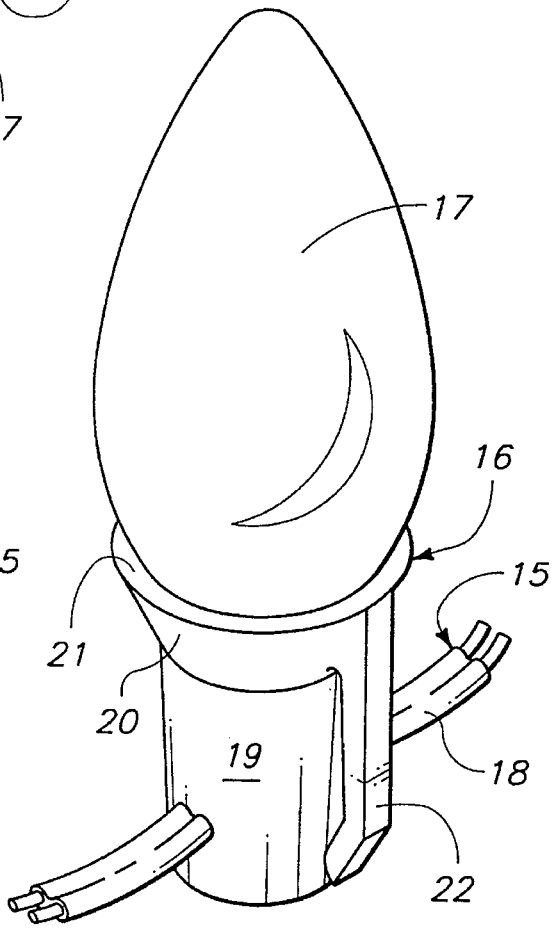
Fig 1 PRIOR ART
FIG. 1 is a perspective view showing a section of a prior art form of Christmas light socket, bulb, and attached wire.

FIG. 1 is provided to show a portion of a generally conventional Christmas light strand 15, for use in conjunction with the first preferred form of the invention. For purposes of this disclosure, the strand 15 includes at least one bulb socket 16, a bulb 17 secured within the socket 16, and an electrical wire 18 leading to and from the socket.

More specifically, the socket 16 includes a substantially frusto-conical body for threadably receiving the bulb 17. In the example shown, the socket body includes a base section 19, and an upper flared section 20. The flared section leads upwardly from the base section 19 to a top rim 21. An integral clip 22 is shown on the body, extending axially over the flared section 20 and base section 19.

It is pointed out that not all conventional lighting strands include light sockets that closely resemble the socket shown. However, the form shown resembles a standard "Gilbert" form of socket common to the decorative lighting industry. Socket sizes known to the industry as C-7 through C-9 are common, and the present mount 10 may be made to fit all such light socket forms and sizes.

In the first preferred form, the present mount 10 is provided as an adapter for attaching the light socket 16 to a support 32. The mount is releasably attached to a conventional light socket 16, and includes features that enable attachment of the socket 16 to a support 32 such as the rod or wire partially shown in FIGS. 6–8.

The first mount 10 is preferably formed of a flexible plastic, injection molded into a solid body 30. Such plastics as polypropylene, acetal, or Nylon have appropriate rigidity, yet sufficient spring-like memory to function well for the present invention.

The body 30 includes a mounting clip 31 for attachment to a support 32 and a socket receiving clip 33 opposed to the mounting clip 31. The clips 31, 33 are shown substantially parallel, formed on parallel central axes, but could also be made at selected angles to one another.

More specifically, the socket receiving clip 33 forms a socket receiving opening 34, defined by a flexible frusto-conical, split clip wall 35. The clip wall 35 is formed with a flared upper section, joined to a lower section shaped to conform with and securely clasp the conventional bulb socket 16.

Figure 6:
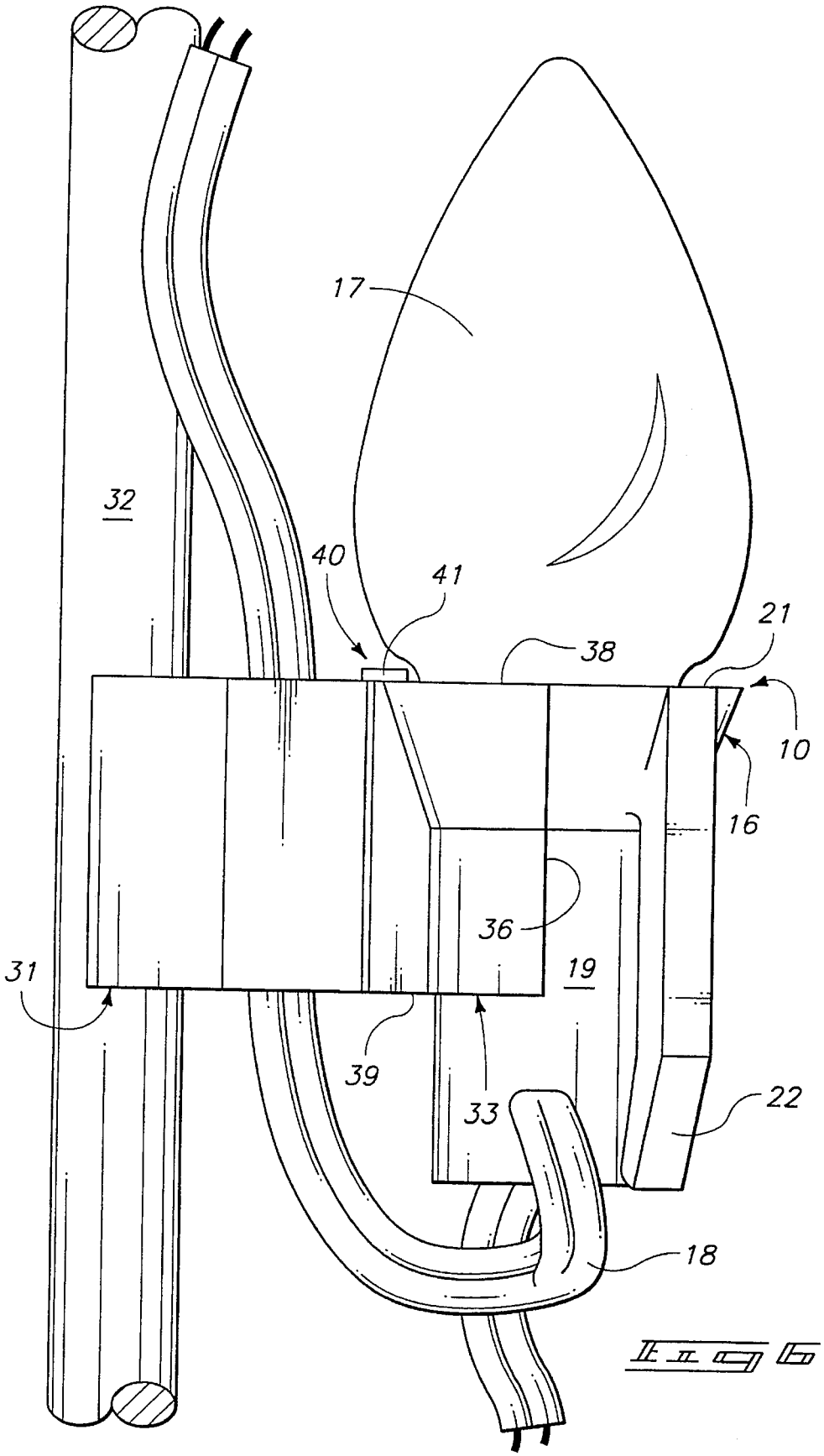
FIG. 6 is an enlarged side elevation view showing the present mount in operation mounting a Christmas light socket, bulb and wire to a support.

The clip wall 35 terminates at edges 36 that are spaced laterally to define an axial opening 37 for receiving the clip 22 of the bulb socket 16 (see FIG. 6). The edges 36 also separate the clip wall, to allow the clip wall 35 to be flexed open to be snapped over the light bulb socket 16.

The clip wall 35 extends axially, along the central socket receiving clip axis between a top end 38, and a bottom end 39. The top end is shaped similarly to the top rim 21 of the bulb socket 16, and is intended to be substantially co-planar with the top rim 21 when the socket 16 is received within the socket receiving clip 33. The bottom end 39 is open to allow the lower portion of the socket 16 to project axially downwardly. This is done so the wire 18 will clear the clip bottom end 39 (see FIGS. 6–8).

A retainer 40 is provided on the body 30 and is positioned thereon to abut the Christmas light bulb socket 16 to prevent axial motion of the socket within the socket receiving clip in one direction. This feature is shown in detail in FIG. 9.

In a preferred form, the retainer is provided in the form of a tab or more preferably, a pair of tabs 41 that are integrally formed with the body 30. It is pointed out that the retainer could take other forms as well. For example, the retainer could take the form of a rim (not shown) extending partially about the top end of the clip wall 35. Further, more or fewer of the tabs 41 could be provided at selected angular positions about the socket receiving clip.

The exemplified tabs 41 are situated along the top end of the clip wall 35, and project substantially radially into the socket receiving opening 34. Bottom surfaces of the tabs are thus located to be coplanar with the top rim 21 of the bulb socket 16.

Figure 9:
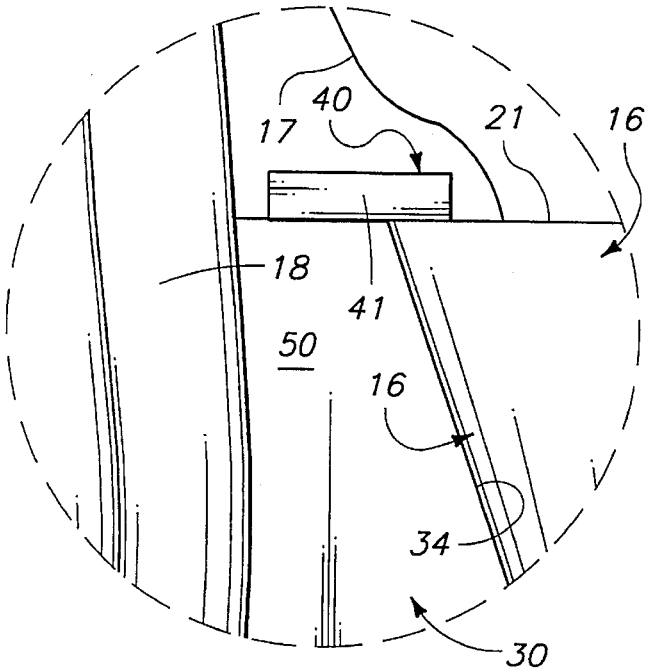
FIG. 9 is an enlarged fragmented detail view of the area indicated within the dashed circle in FIG. 8.

The tabs 41 are thus positioned to abut with the top rim 21 of the bulb socket 16, as shown in FIG. 9. The tabs 41 do not project so far into the opening 34 to prevent the bulb socket 16 from sliding into the opening 34 but will snap over the rim 21 once the socket is in proper position. They then function to prevent the bulb socket from sliding upwardly out of the socket receiving clip 33. The frusto-conical configuration of the clip 33 functions to prevent the bulb socket from sliding out downwardly, so the bulb socket is held firmly but releasably in axial position.

The mounting clip 31 is positioned in opposition to the socket receiving clip 33. It is formed along a central axis that is substantially parallel to the central axis of the socket receiving clip 33. It is pointed out again, however, that the mounting clip 31 could be angularly positioned at other than the parallel orientation shown. For example, the central axes of the socket receiving clip 33 and mounting clip 31 could be substantially perpendicular, to allow the bulb socket 16 to be oriented substantially perpendicular to the support 32.

In the preferred form shown, the mounting clip 31 includes a pair of opposed yieldable arms 46. The arms 46 are shaped at outer ends to form a support receiving opening 47 that is complementary to the support to which the lights are to be mounted.

In the example shown, the opening 47 is semi-circular to receive a rod of similar cross-sectional shape. This form can be made differently, but for wrought iron sculptures in popular use for Christmas decorative lighting, the semi-circular configuration is preferred. In fact, the clip can be made in various sizes and shapes to snap over and secure the mount and socket to various supports which might include wires, rods, rain trough edges, tree limbs, or other common configurations.

The mounting clip is preferably formed integrally with the body 30, and is split axially so the arms 46 can be sprung apart and snapped over the support. The inherent flexibility of the plastic material will allow for some variation in the shape and size of the support to which the lights are to be secured. The elastic or resilient nature of the materials also allows the arms 46 to spring back toward their original orientation, firmly gripping the support and holding the body and light securely in position.

Figure 7:
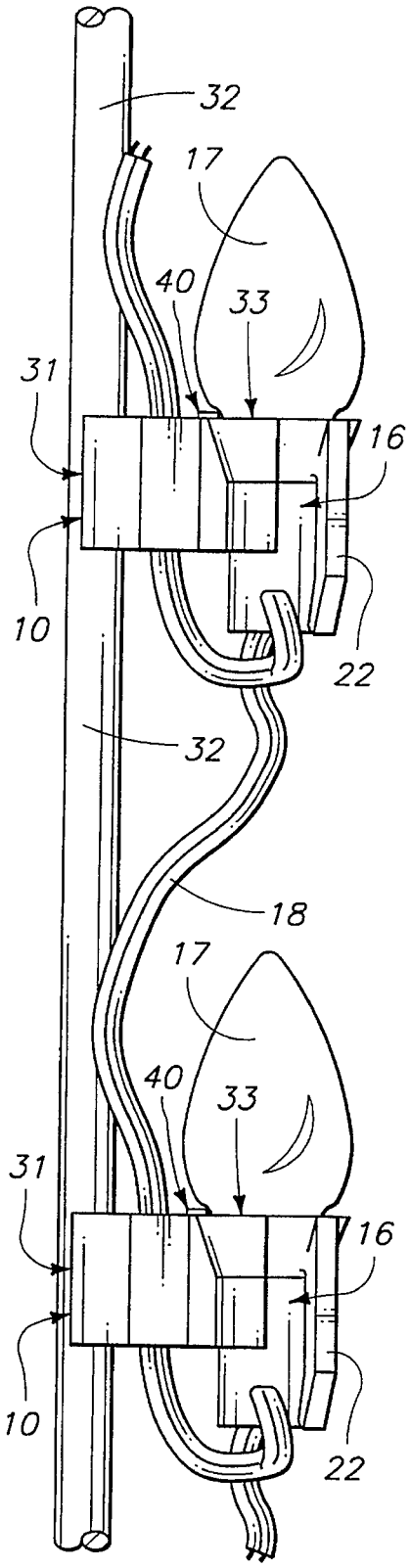
FIG. 7 is a view similar to FIG. 6 on a reduced scale and showing two mounts securing two lights in a strand to a support.
Figure 8:
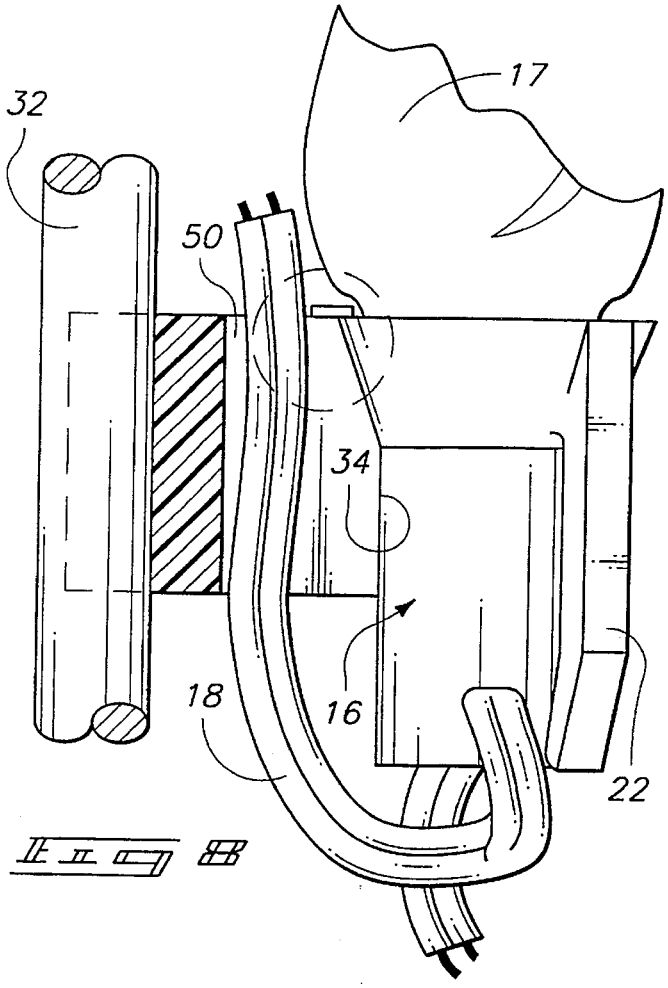
FIG. 8 is a sectional view through the mount with a light socket mounted therein.

A wire retainer channel 50 is defined by the body and, in a preferred form, is formed therein adjacent the socket receiving opening 34. In the preferred form illustrated, the channel 50 opens into the socket receiving opening 34. It extends axially along the full length of the body to releasably receive the light wire 18 (FIGS. 6–8). Although the channel is shown in an axial orientation, other angular positions could be used. For example, the channel 50 could be perpendicular to the central axis of the socket.

The channel 50 performs the important function of orienting and holding the wire 18 somewhat parallel to the light bulbs 17 (FIG. 7). The wire can thus be organized in an orderly manner. In the configuration shown, the channel becomes closed on one side by the bulb socket 16 when the bulb socket is secured within the socket receiving opening 34 (see FIG. 8). The wire is thus securely held in position.

In attaching the mount to a light strand, the wire 18 is first gathered and fitted through the axial opening and into the wire retainer channel 50. Next, the body 30 is secured to a light bulb socket 16. This is done by holding the wire in place and forcibly sliding the bulb socket 16 into the socket receiving clip 33. The clip wall 35 will spring apart, then snap over the complementary parts of the socket base section 19, and the tabs will likewise snap or come into abutment with the socket top rim 21. The mount is now securely yet releasably mounted to the bulb socket, and is ready for attachment to a support 32.

To secure the mount and socket to a support, the mounting clip 31 is simply snapped over the support. This process may be repeated for each bulb socket along the strand 15, substantially as shown in FIG. 7. The lights will be positioned in an orderly manner and in alignment along the support.

In the second preferred form shown in FIGS. 10–15, the mount 10 includes an integrated socket and clip, integrated in a common body 60. The body 60, as with the first mount described above, may be formed of injection molded plastic. This configuration is desirable for those who manufacture strands of lights, or for those who construct custom lighting arrangements, particularly for Christmas or other holiday or event displays.

The body 60 is preferably formed of a flexible plastic, injection molded into the solid body 60. The body 60 may also be formed of plastics such as polypropylene, acetal, or Nylon.

The body is shaped with electrical contact mounts, exemplified as internal stopped slots 54, 55 for mounting conventional electrical contacts 56, 57 that facilitate electrical connection to a bulb. Such contacts 56, 57 include points 58, 59 (FIG. 14) that facilitate electrical connection to a conductive wire. The contacts may be mounted by the manufacturer completing the light strands, along with the wire 18.

The body 60 includes a mounting clip 61 for attachment to a support 32 and a light socket 63 opposed to the mounting clip 61. The clip 61, and light socket 63 are shown substantially parallel, formed on parallel central axes, but could also be made at selected angles to one another.

More specifically, the socket 63 forms a threaded bulb recess 64, defined by a frusto-conical wall 65. The wall 65 is cup shaped, formed with a flared upper section, joined to a lower section shaped with internal integral threads 65a to conform with and threadably clasp the complementary threaded portion of a conventional decorative light bulb 17. The internal stopped slots 54, 55 are positioned in relation to the threads 65*a* to situate the conventional contacts 56, 57 for proper electrical connection to a bulb.

Figure 15:
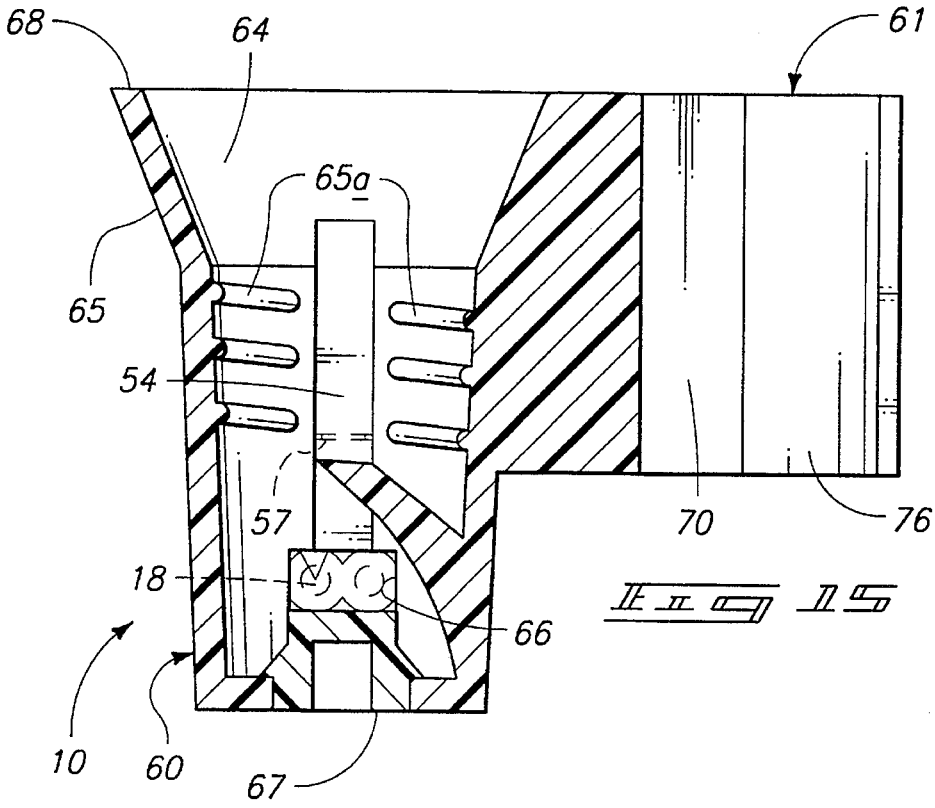
FIG. 15 is a sectional view taken substantially along line 15—15 in FIG. 13.

The socket wall 65 includes a transverse, downwardly open conductor wire receiving slot 66 that is shaped to receive a snap block 67 (FIG. 11), used to secure the wire 18 in position within the socket. The block 67 is flanged and will snap substantially permanently in position as shown in FIG. 15 to secure the wire in firm electrical contact with the contacts 56, 57.

The socket wall 65 extends axially, along the central axis between a top end 68, and a bottom end 69. The top end 65 is open to receive the bulb. The bottom end 69 is slotted as described above to receive the wire 18 and block 67.

The mounting clip 61 is positioned in opposition to the socket 63. It is formed along a central axis that is substantially parallel to the central axis of the socket 63. It is once again pointed out that the mounting clip 61 could be angularly positioned at other than the parallel orientation shown. For example, the central axes of the socket 63 and mounting clip 61 could be substantially perpendicular, to allow the bulb 16 to be oriented substantially perpendicular to the support 32.

In the example shown, the mounting clip 61 includes a pair of opposed yieldable arms 76. The arms 76 are shaped at outer ends to form a support receiving opening 67 that is complementary to the support 32 to which the lights are to be mounted.

In the example shown, the support receiving opening 67 is semi-circular to receive a rod of similar cross-sectional shape. This form can be made differently and in different sizes as described above.

The mounting clip 61 is preferably formed integrally with the body 60, and is split axially so the clip arms 76 can be sprung apart and snapped over the support 32, in a manner identical or similar to that described above for the clip arms 76.

A wire retainer channel 70 is defined by the body 60. The channel, in a preferred form, is formed therein adjacent the mounting clip 61. Channel 70, like channel 50 is shown substantially parallel to the socket axis. However, the mount could be produced with a channel 70 oriented in another angular orientation.

In the preferred form illustrated, the wire retainer channel 70 opens into the support receiving opening 67 of the mounting clip 61. It extends axially along the full length of the body to releasably receive the light wire 18 (FIGS. 11, 12, 13, and 15).

Figure 10:
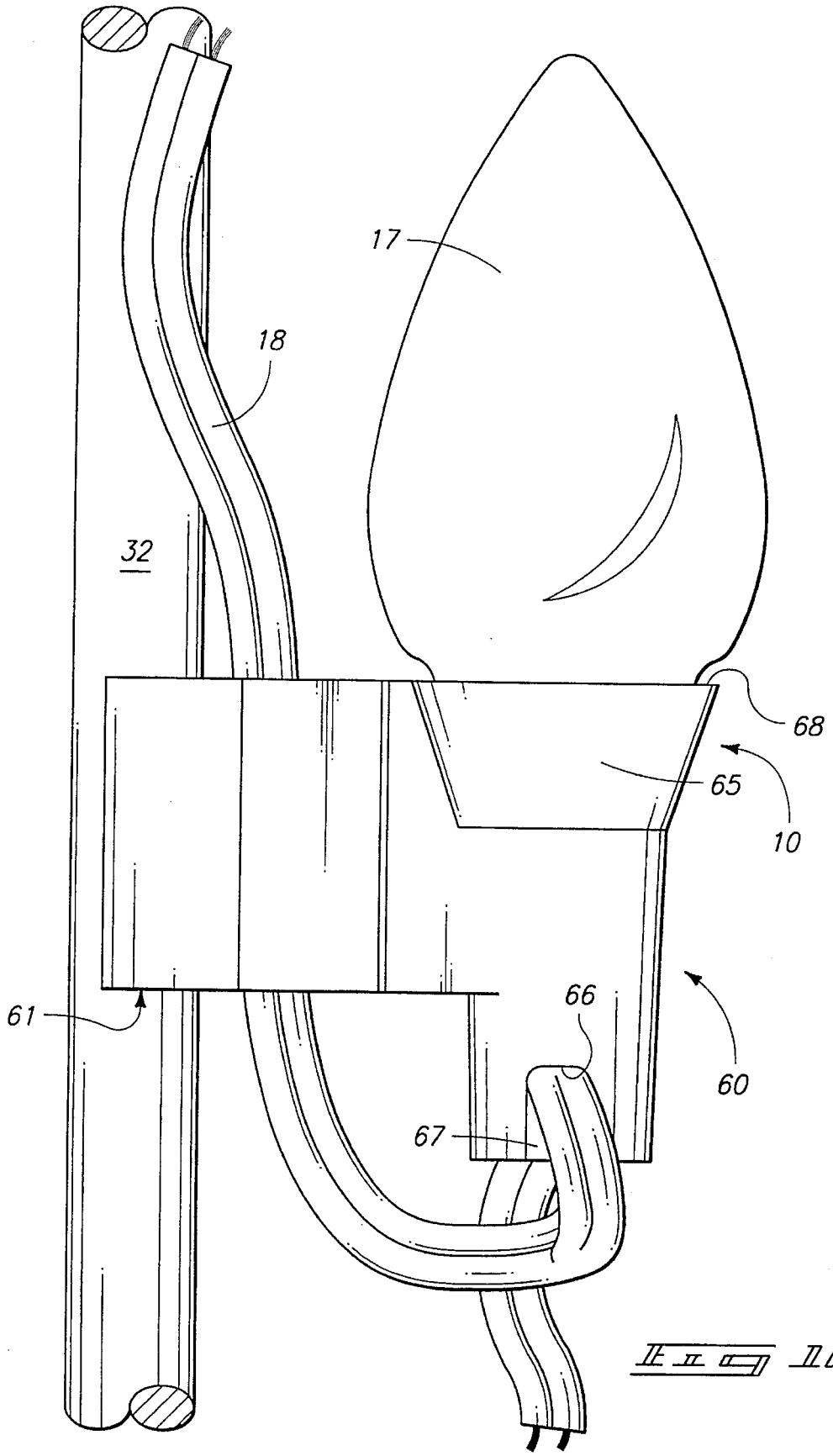
FIG. 10 is an enlarged side elevation view of a second preferred form of the invention showing integration with a Christmas light socket and in operation mounting a Christmas light bulb and wire to a support.
Figure 11:
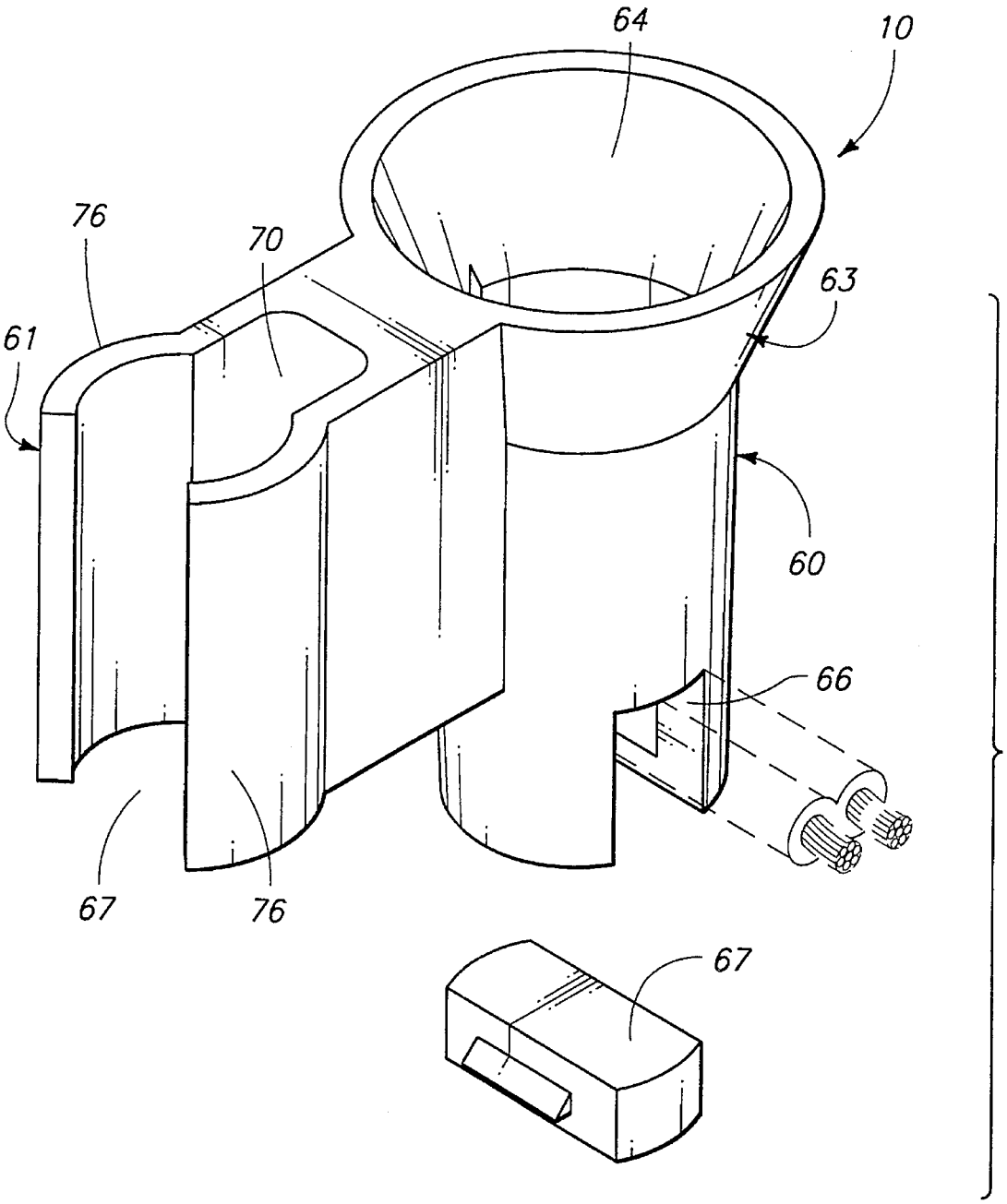
FIG. 11 is an exploded perspective view of the second preferred form.
Figure 12:
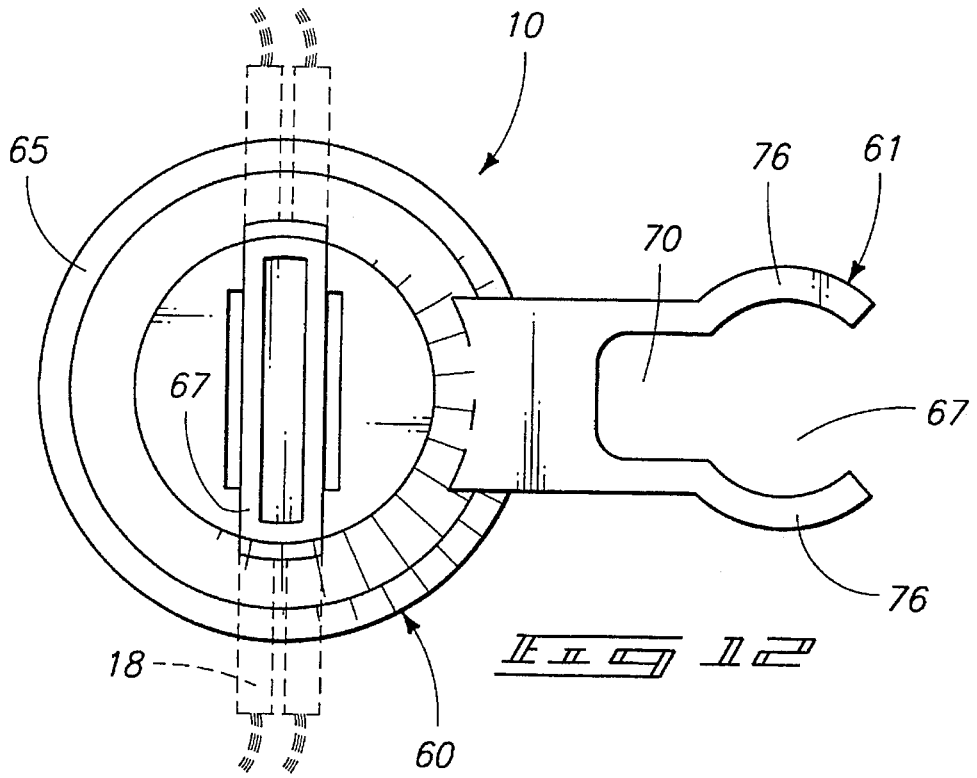
FIG. 12 is a bottom plan view of the second preferred form.
Figure 13:
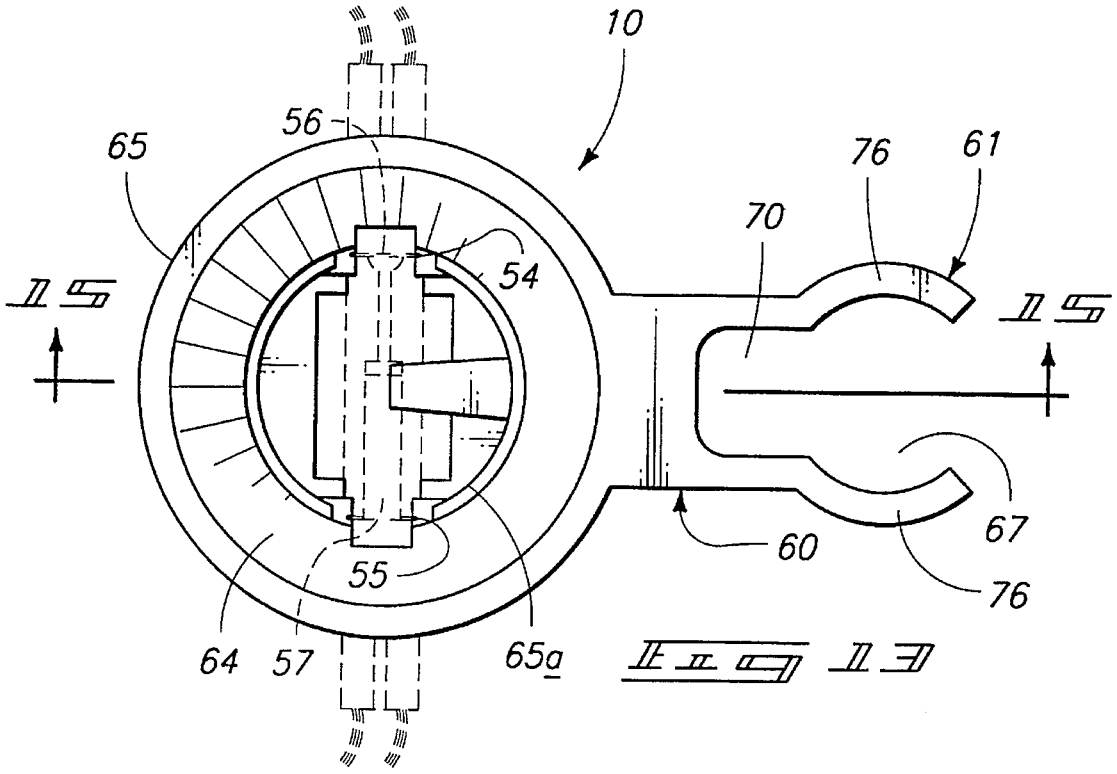
FIG. 13 is a top plan view of the second preferred form.
Figure 14:
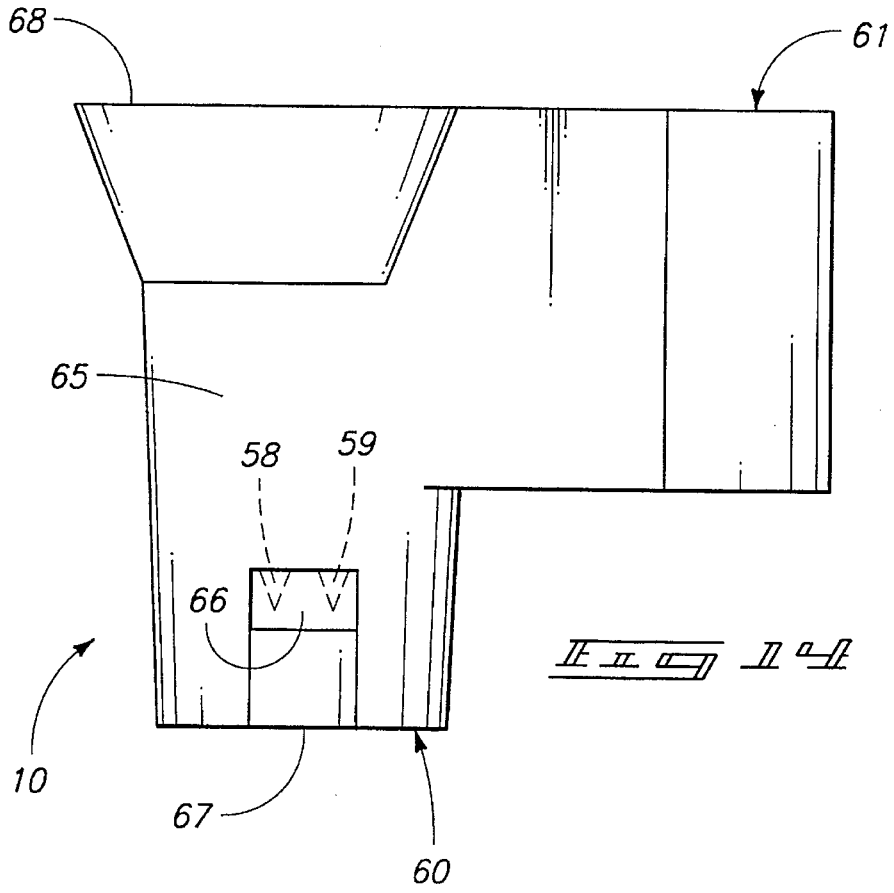
FIG. 14 is a side elevation view of the second preferred form.

The channel 70 performs a function similar to channel 50 described above, of orienting and holding the wire 18 relative to the light bulbs 17 (FIG. 10). In the configuration shown, the channel 70 becomes closed on one side by the support 32 when the mounting clip 61 is attached. The wire is thus securely retained in position.

To assemble the present socket in a light strand, a pair of contacts 56, 57 are first secured within the socket. This may be done simply by sliding the contacts either by hand or by automated machinery into the stopped slots 54, 55 provided. Next, the wire 18 is positioned within the conductor wire mounting slot 66 at a selected position along the wire length.

Next the block 67 is forced into the conductor wire mounting slot 66, snapping into position and forcing the wire against the points of the contacts. The points pierce the insulation on the wire and make electrical contact with the encased electrically conductive wire. The socket is now substantially permanently attached to the wire and is ready to receive a bulb and be mounted to a support 32.

To mount the socket to a support, the wire is first fitted into the wire receiving channel 70 in the manner desired. The wire is then held in this position while the mounting clip 61 is snapped over the support 32. This process may be repeated for each mount 10 along the strand, substantially as shown for the earlier described mount in FIG. 7. The lights will be positioned in an orderly manner.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A decorative lighting mount, comprising:

a body including a mounting clip for attaching the mount to a support, and a socket receiving clip for reception of a decorative light bulb socket;

wherein the mounting clip includes a pair of opposed yieldable clip arms forming a support receiving opening therebetween;

wherein the socket receiving clip is formed along a socket axis and is shaped with an opening to releasably receive portion of a decorative light bulb socket; and wherein the socket receiving clip includes a retainer thereon positioned to abut a top edge surface of the decorative light bulb socket to prevent axial motion of the socket within the socket receiving clip in one direction.

2. A decorative lighting mount as claimed by claim 1, further comprising a wire receiving channel defined by the body and formed therein adjacent the socket receiving clip.

3. A decorative lighting mount as claimed by claim 1, further comprising a wire receiving channel defined by the body and formed therein between the mounting clip and socket receiving clip.

4. A decorative lighting mount as claimed by claim 1, further comprising a wire receiving channel defined by the body and opening into the socket receiving opening and formed in the body between the mounting clip and socket receiving clip.

5. A decorative lighting mount as claimed by claim 1, further comprising a wire receiving channel defined by the body and oriented substantially parallel to the socket axis between the mounting clip and socket receiving clip.

6. A decorative lighting mount as claimed by claim 1, wherein the retainer includes at least one tab on the socket receiving clip, projecting into the socket receiving opening.

7. A decorative lighting mount as claimed by claim 1, further comprising a wire receiving channel defined by the body and formed therein adjacent the socket receiving clip; and wherein the retainer includes at least one tab on the socket receiving clip, projecting into the socket receiving opening.

8. A decorative lighting mount as claimed by claim 1, wherein the socket receiving clip includes a clip wall extending partially about the socket axis and terminating at end edges forming an axial opening adapted to accommodate the decorative lighting socket having an axial clip thereon.

9. A decorative lighting mount as claimed by claim 1, wherein the socket receiving clip includes open top and bottom ends.

10. A decorative lighting mount as claimed by claim 1, wherein the support receiving opening of the mounting clip is formed along a mounting clip axis and wherein the socket axis is substantially parallel to the mounting clip axis.

11. A decorative lighting mount as claimed by claim 1, wherein the body is formed of a flexible material and wherein the mounting clip and socket receiving clip are flexible to resiliently flex and spring against the support and the decorative lighting socket.

12. A decorative lighting mount, comprising:

a plastic body including a flexible integral mounting clip for attaching the mount to a support, and an integral flexible socket receiving clip for reception of a decorative light bulb socket;

wherein the mounting clip includes a pair of opposed yieldable clip arms forming a support receiving opening therebetween along a mounting clip axis;

wherein the socket receiving clip defines a socket receiving opening formed along a socket axis with opposed open ends along the socket axis;

the socket receiving clip including an axially split side wall extending between an upper section and an integral lower section, the upper section being flared radially outward in a frusto-conical configuration to releasably receive a portion of the decorative light bulb socket; and wherein the socket receiving clip includes a retainer thereon projecting radially into the socket receiving opening to abut the decorative light bulb socket held within the socket receiving clip to prevent axial motion of the decorative light bulb socket within the socket receiving clip in one axial direction.

13. A decorative lighting mount as claimed by claim 12, further comprising a wire receiving channel defined by the body and formed therein adjacent the socket receiving clip.

14. A decorative lighting mount as claimed by claim 12, further comprising an axial wire receiving channel openly communicating with the socket receiving opening.

15. A decorative lighting mount as claimed by claim 12, wherein the mounting clip axis and the socket receiving clip are substantially parallel.

16. A decorative lighting mount as claimed by claim 12, further comprising an axial wire receiving channel formed in the body and positioned between the socket receiving clip and the mounting clip and in open communication with the socket receiving opening.

17. A mount for decorative lights including a bulb socket and a wire leading to the bulb socket, comprising:

a body including a mounting clip for attaching the mount to a support, and a socket receiving clip for reception of the decorative light bulb socket;

wherein the mounting clip includes a pair of opposed yieldable clip arms forming a support receiving opening therebetween;

wherein the socket receiving clip is formed along a socket axis and is shaped with an opening substantially parallel to the support receiving opening to releasably receive a portion of the decorative light bulb socket; and a wire receiving slot formed in the body substantially parallel to and adjacent the support receiving opening to releasably receive a decorative light wire with the decorative light bulb socket received within the socket receiving opening.

18. A decorative light bulb mount, comprising:

a body including a bulb socket;

the bulb socket having a elongated recess for receiving a decorative light bulb;

the bulb socket including electrical contact mounts formed within the recess;

a mounting clip on the body for attaching the mount to a support;

wherein the mounting clip includes at least one yieldable clip arm forming a support receiving opening; and a wire retainer channel formed in the body separate from and adjacent the mounting clip and substantially parallel to the elongated recess of the bulb socket, adapted to releasably receive a portion of a conductor wire.

19. A decorative light bulb mount as claimed by claim 18, wherein the wire retainer channel is formed in the body and opens into the support receiving opening.

* * * * *